US009314663B2

(12) United States Patent
Hsu

(10) Patent No.: US 9,314,663 B2
(45) Date of Patent: Apr. 19, 2016

(54) ALTERNATIVE DRIVING DEVICE AND SITTING-TYPE EXERCISE MACHINE HAVING THE ALTERNATE DRIVING DEVICE

(71) Applicant: HealthCare International, Inc., Langley, WA (US)

(72) Inventor: Ching-Lu Hsu, Taipei (TW)

(73) Assignee: HEALTHCARE INTERNATIONAL, INC., Langley, WA (US)

( * ) Notice: Subject to any disclaimer, the term of this patent is extended or adjusted under 35 U.S.C. 154(b) by 24 days.

(21) Appl. No.: 14/191,709

(22) Filed: Feb. 27, 2014

(65) Prior Publication Data

US 2015/0238804 A1 Aug. 27, 2015

(51) Int. Cl.

| | |
|---|---|
| ***A63B 22/12*** | (2006.01) |
| ***A63B 22/00*** | (2006.01) |
| ***A63B 23/035*** | (2006.01) |
| ***A63B 21/22*** | (2006.01) |

(52) U.S. Cl.

CPC ..... *A63B 22/001* (2013.01); *A63B 21/225* (2013.01); *A63B 22/0056* (2013.01); *A63B 23/03533* (2013.01)

(58) Field of Classification Search

CPC ..... A63B 21/225; A63B 21/1465; A63B 23/03533; A63B 23/03575; A63B 23/03591; A63B 23/0583; A63B 23/035; A63B 23/03525; A63B 22/001; A63B 22/0076; A63B 2022/0043; A63B 2022/0652; A63B 23/0355

See application file for complete search history.

(56) References Cited

U.S. PATENT DOCUMENTS

| | | | | |
|---|---|---|---|---|
| 3,482,835 | A * | 12/1969 | Dean | 482/108 |
| 5,356,356 | A * | 10/1994 | Hildebrandt et al. | 482/62 |
| 6,042,518 | A * | 3/2000 | Hildebrandt et al. | 482/57 |
| 8,475,341 | B1 * | 7/2013 | Al-Hawaj et al. | 482/62 |
| 2003/0096677 | A1 * | 5/2003 | Chu | 482/57 |
| 2010/0113228 | A1 * | 5/2010 | Wu | 482/72 |

* cited by examiner

*Primary Examiner* — Oren Ginsberg
*Assistant Examiner* — Nyca T Nguyen
(74) *Attorney, Agent, or Firm* — Ming Chow; Sinorica, LLC

(57) ABSTRACT

A sitting type exercise machine has a frame, a flywheel, and an alternative driving device. The alternative driving device includes a base two driving units, and two driven units. The driving units and two driven units are provided on the base for rotation. A space is left between the driving units to let the driving units move independently. Therefore, the driving units respectively drive the driven units to move in the same direction. The frame is provided with a seat to let the user do exercise in a sitting posture which may reduce the loading on the knees during exercise.

4 Claims, 6 Drawing Sheets

ALTERNATIVE DRIVING DEVICE AND SITTING-TYPE EXERCISE MACHINE HAVING THE ALTERNATE DRIVING DEVICE

BACKGROUND OF THE INVENTION

1. Technical Field

The present invention relates generally to an exercise machine, and more particular to an alternative driving device for a sitting-type exercise machine.

2. Description of Related Art

Stepper is a leg trainer to perform a stair climbing type exercise. A conventional stepper is provided with two pedals for user to stand on them and step. The drawback of such stepper is that the user has to sustain his/her body weight with legs while he/she is doing exercise with the stepper. The user is taking a heavy loading on the knees, and it will be worse while the user does not keep balance. Besides, the conventional stepper only trains leg's muscles. It does not provide a whole-body's training.

BRIEF SUMMARY OF THE INVENTION

In view of the above, the primary objective of the present invention is to provide an alternative driving device and a sitting-type exercise machine having the alternative driving device, which provides a comfortable and smooth exercise to reduce the loading of knees.

The present invention provides an alternative driving device, including a base, a first driving unit, a second driving unit, a first driven unit, and a second driven unit. The first driving unit is pivotally connected to the base, and has a tube and an extending member, wherein the tube is connected to a first exerting portion, and the extending member is connected to the tube. The second driving unit is pivotally connected to the base, and has a tube and an extending member, wherein the tube is connected to a first exerting portion, and the extending member is connected to the tube. A space is left between the extending members of the first driving unit and the second driving unit to let the extending members move independently. The first driven unit has a connecting shaft passing through the tube of the second driving unit and connected to the extending member of the first driving unit, wherein the connecting shaft is connected to a second exerting portion, and the first exerting portion connected to the first driving unit and the second exerting portion connected to the first driven unit move in the same direction. The second driven unit has a connecting shaft passing through the tube and connected to the extending member of the second driving unit, wherein the connecting shaft is connected to a second exerting portion, and the first exerting portion connected to the second driving unit and the second exerting portion connected to the second driven unit move in the same direction.

The present invention further provides a sitting-type exercise machine, including a frame, a flywheel, a first driving unit, a second driving unit, a first driven unit, and a second driven unit. The flywheel is provided on the frame for rotation, and has two eccentric pivoting portions. The first driving unit is pivotally connected to a base of the frame, and has a tube, a connecting arm, an extending member, a pedal bar, and a pedal, wherein the connecting arm is connected to the tube and pivoted on one of the pivoting portions of the flywheel; the extending member is connected to the tube; and the pedal is connected to the tube through the pedal bar. The second driving unit is pivotally connected to the base of the frame, and has a tube, a connecting arm, an extending member, a pedal bar, and a pedal, wherein the connecting arm is connected to the tube and pivoted on the other pivoting portion of the flywheel; the extending member is connected to the tube; and the pedal is connected to the tube through the pedal bar. A space is left between the extending members of the first driving unit and the second driving unit to let the extending members move independently. The first driven unit has a connecting shaft and a handle, wherein the connecting shaft of the first driven unit passes through the tube of the second driving unit to be connected to the extending member of the first driving unit; the handle is connected to the connecting shaft, whereby the handle of the first driven unit and the pedal of the first driving unit move in the same direction. The second driven unit has a connecting shaft and a handle, wherein the connecting shaft of the second driven unit passes through the tube of the first driving unit to be connected to the extending member of the second driving unit; the handle is connected to the connecting shaft, whereby the handle of the second driven unit and the pedal of the second driving unit move in the same direction.

With such design, when the driving units and the driven units turn the flywheel. The space is provided to let the driving units move independently to narrow the space in the exercise machine. The seat lets the user do exercise in a sitting posture to reduce the loading on the knees during exercise.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
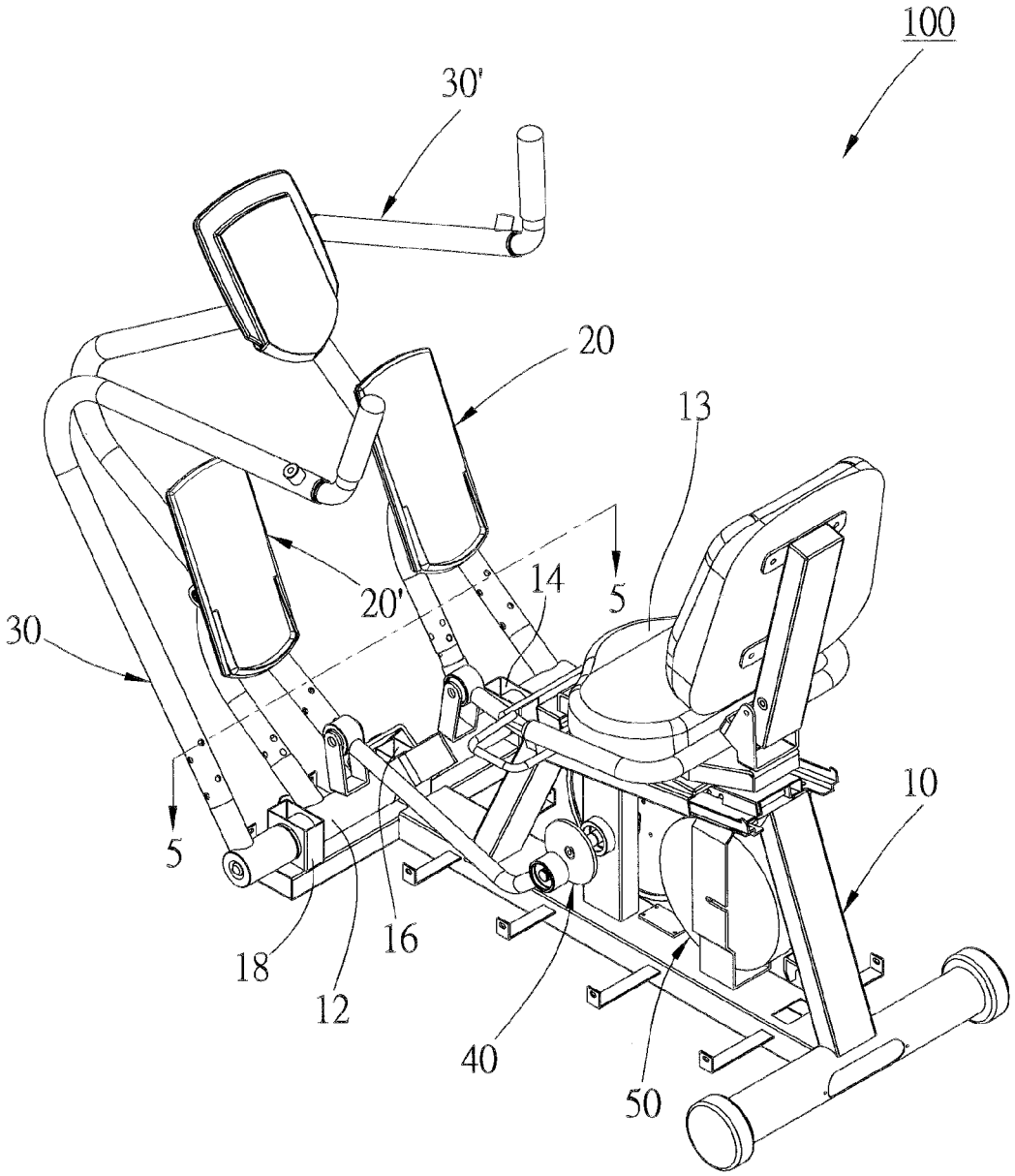
FIG. 1 is a perspective view of a preferred embodiment of the present invention.

As shown in FIG. 1 to FIG. 6, a sitting-type exercise machine 100 of the preferred embodiment of the present invention includes a frame 10, a first driving unit 20, a second driving unit 20', a first driven unit 30, a second driven unit 30', a flywheel 40, and a driven wheel 50. The frame 10 has a base 12. An alternative driving device of the present invention includes the base 12, the first and the second driving units 20, 20', and the first and the second driven units 30, 30'.

Figure 2:
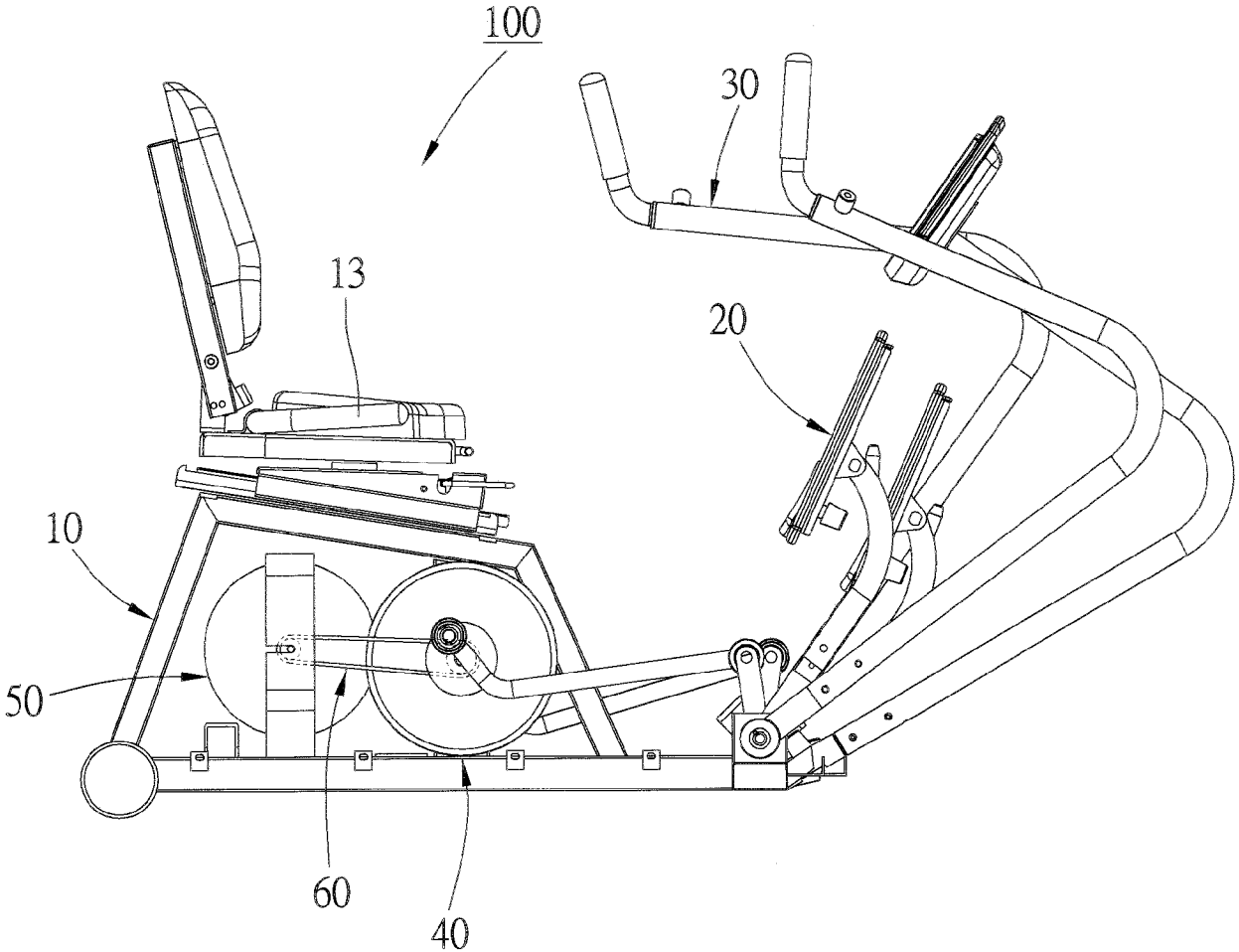
FIG. 2 is a right view of the preferred embodiment of the present invention, showing the driven wheel, the flywheel, and the belt.

As shown in FIG. 1 and FIG. 2, the frame 10 has a plurality of shafts connected together. The base 12 is provided with three separated bearing seats 14, 16, 18, and the bearing seats 14, 16, 18 are arranged in a line. A seat 13 is provided on the frame 10 to for user to sit. The flywheel 40 and the driven wheel 50 are provided on the frame for free rotation. The flywheel 40 is connected to the driven wheel 50 through a belt 60 so that the flywheel 40 may drive the driven wheel 50 to turn.

Figure 3:
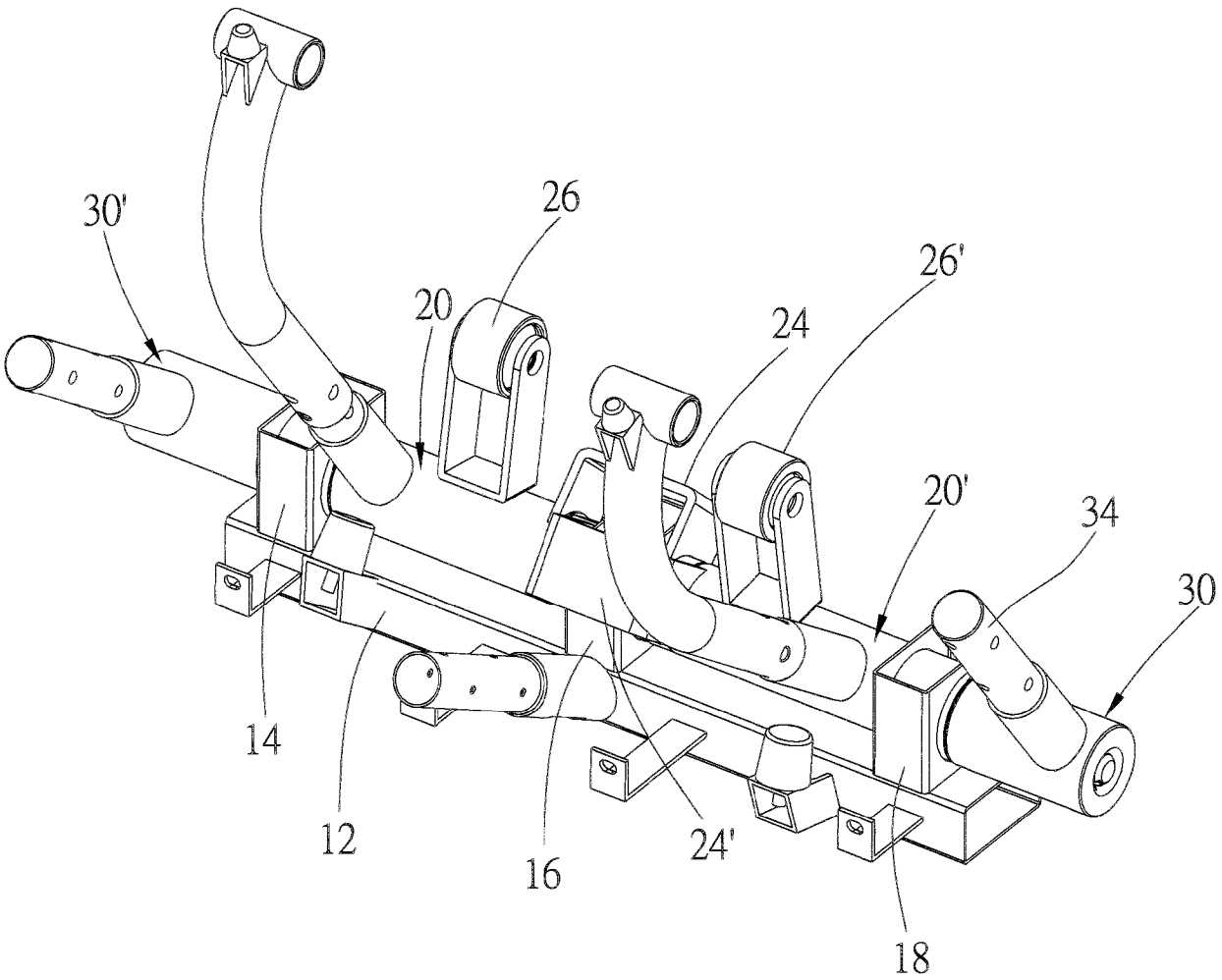
FIG. 3 is an enlarged view, showing the driving units and the driven units.

As shown in FIG. 3, the first and the second driving units 20, 20' are the same. The first driving unit 20 is between the bearing seats 14, 16, and the second driving unit 20' is between the bearing seats 16, 18. The first and the second driven units 30, 30' are the same too. The first driven unit 30 is located at an outer side of the bearing seat 18 and the second driven unit 30' is located at an outer side of the bearing seat 14. In an embodiment, the driving unit 20 moves along with the driven unit 30, and the second driving unit 20' moves along with the second driven unit 30'. Therefore, we only explain the structure and the function of the first driving unit 20 and the first driven unit 30 hereafter.

Figure 4:
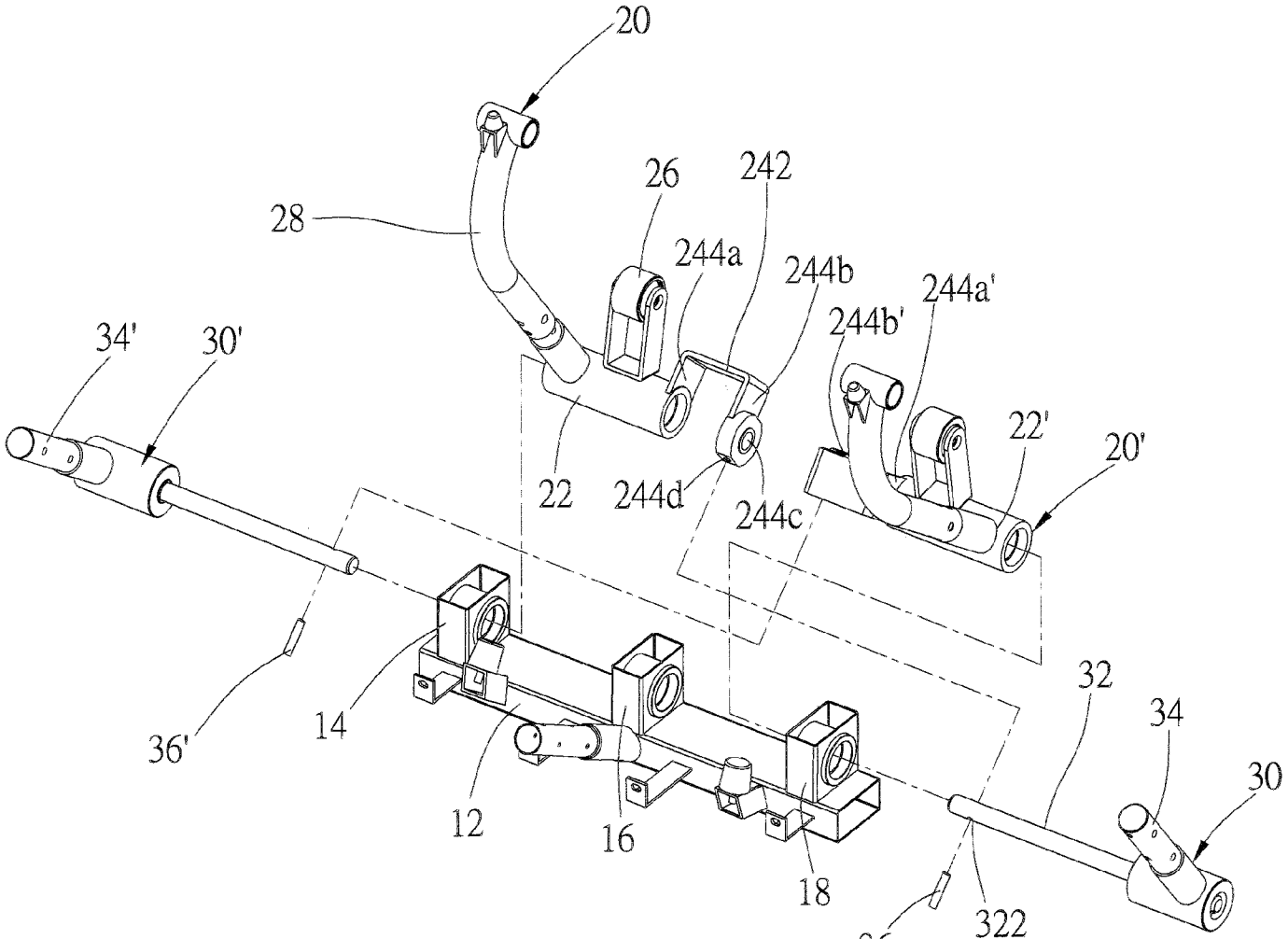
FIG. 4 is an exploded view of the driving units and the driven units of the preferred embodiment of the present invention.
Figure 5:
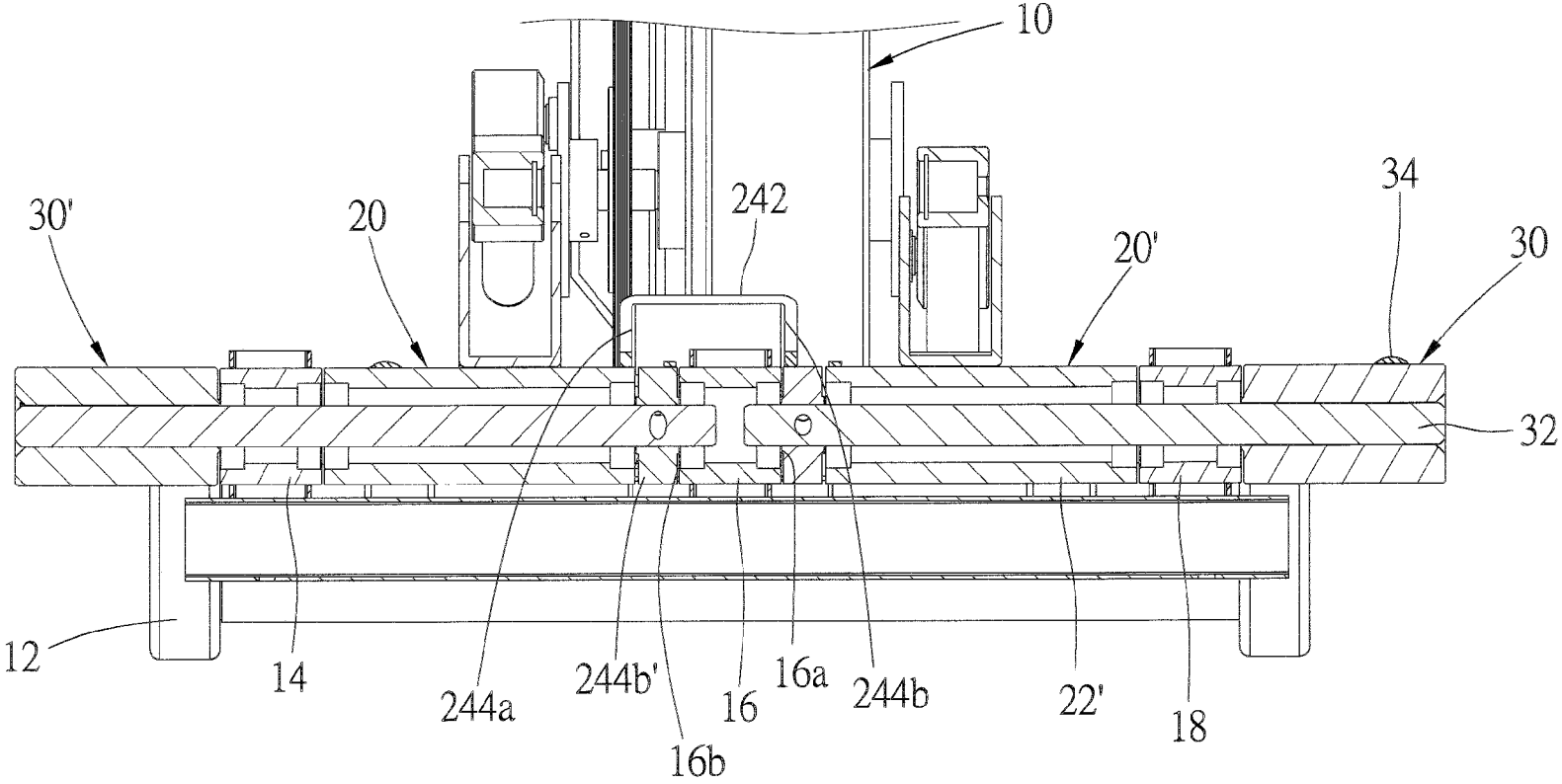
FIG. 5 is a sectional view along the 5-5 line in FIG. 1.

As shown in FIG. 4 and FIG. 5, the first and the second driving units 20, 20' each has a tube 22, 22', an extending member 24, 24', a connecting arm 26, 26', and a pedal bar 28, 28'. The extending member 24 or 24' includes a connecting board 242 or 242' and two lateral boards 244*a*, 244*b* or 244*a'*, 244*b'*. The connecting board 242, or 242' has opposite ends connected to the lateral boards 244*a*, 244*b* or 244*a'*, 244*b'*, and the tube 22 or 22' is connected to the lateral board 244*a* or 244*a*. The lateral board 244*b* or 244*b'* has an axial bore 244*a* and a locking bore 244*b*, and they are communicated with each other. The lateral boards 244*a*, 244*b* or 244*a'*, 244*b'* are kept a predetermined distance from each other. The extending member 24 or 24' is a U-shaped member. Two pedals 282 and 282' are connected to the pedal bars 28, 28' respectively. In an embodiment, the pedals 282 or 282' are defined as first exerting portions for a user to step them by foot. The connecting board 242 of the first driving unit 20 runs over the bearing seat 16, and the lateral board 244*b* is attached to a side 16*a* of the bearing seat 16, which is adjacent to the bearing seat 18. The connecting board 242' of the second driving unit 20' runs over the bearing seat 16 from an opposite side, and the lateral board 244*b'* is attached to the other side 16*b* of the bearing seat 16, which is adjacent to the bearing seat 14. In such situation, the lateral board 244*b* of the first driving unit 20 is between the lateral board 244*a'* of the second driving unit 20' and the bearing seat 16, and the lateral board 244*b'* of the second driving unit 20' is between the lateral board 244*a* of the first driving unit 20 and the bearing seat 16.

Figure 6:
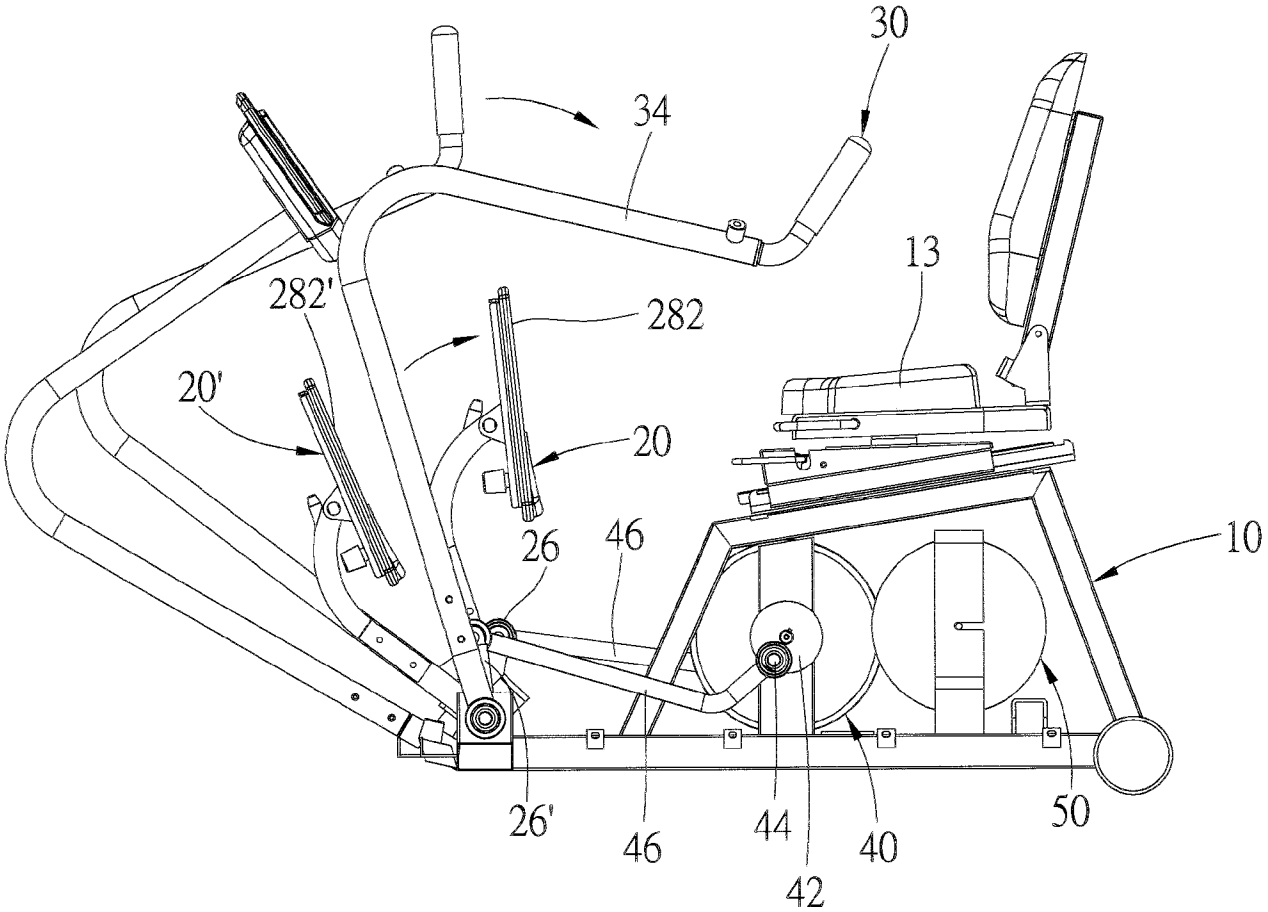
FIG. 6 is a left view of the preferred embodiment of the present invention, showing the handles and the pedals.

The first driven unit 30 has a connecting shaft 32, a handle 34, and a pin 36. As shown in FIG. 5, the connecting shaft 32 passes through the bearing seat 18, the tube 22' of the second driving unit 20', the axial bore 244*c* of the lateral board 244*b* of the driving unit 20 in sequence, and then enters the bearing seat 16. As shown in FIG. 4, the connecting shaft 32 has a through hole 322, which is aligned with the locking bore 244*d* of the lateral board 244*b*, and the pin 36 is inserted into the locking bore 244*d* and the through hole 322 to fix the connecting shaft 32 to the lateral board 244*b*. The same as above, the second driven unit 30' has a connecting shaft 32' which passes through the bearing seat 14, the tube 22 of the first driving unit 20, the axial bore 244*c* of the lateral board 244*b'* of the second driving unit 20' in sequence, and then enters the bearing seat 16 to be connected to the lateral board 244*b'* of the second driving unit 20' by a pin 36'. Therefore, the first driving unit 20 at a right side of the exercise machine 100 is connected to the first driven unit 30 at a left side, and the second driving unit 20' at the left side is connected to the second driven unit 30' at the right side. As shown in FIG. 6, the handle 34 is connected to the connecting shaft 32 at a portion which is left out of the bearing seat 18. The handle 34 is defined as a second exerting portion for a user to swing by hand. Therefore, the handle 34 moves along with the pedal 282, and they move in the same direction.

The flywheel 40 has two disks 42 attached to opposite sides thereof, and two arms 46 connected to the disks 42 respectively. Each disk 42 has a pivoting portion 44 which is located at a portion away from a center of the disk 42, and an end of the arm 46 is pivoted on the pivoting portion 44. In other words, the arm 46 is connected to the pivoting portion 44 eccentrically. An opposite end of the arm 46 is pivotally connected to the connecting arm 26 of the first driving unit 20. The other arm 46 has opposite ends pivotally connected to the pivoting portion 44 of the other disk 42 and the connecting arm 26' of the second driving unit 20'. While a user steps the pedals 282, 282', it will turn the flywheel 40.

As shown in FIG. 3 and FIG. 6, while a user repeatedly steps the pedals 282, 282' of the driving units 20, 20', it will turn the flywheel 40 continuously. At the same time, the handles 34, 34' will move synchronously. With the extending member 24, 24', the driving unit 20 or 20' and the driven unit 30 or 30' at opposite sides are connected together.

In the present embodiment, a user sits down on the seat 13 of the frame 10, puts his/her feet on the pedals 282, 282', and holds the handle 34, 34' by hands. With a sitting posture, it may reduce the loading of user's knees during exercise. As shown in FIG. 2, a resistance of the flywheel 40 may be adjusted by increasing or decreasing a tension of the belt 60 to fit the physical condition of the user.

It must be pointed out that the embodiments described above are only some preferred embodiments of the present invention. All equivalent structures which employ the concepts disclosed in this specification and the appended claims should fall within the scope of the present invention.

What is claimed is:

1. A sitting-type exercise machine, comprising:

a frame having a base;

a flywheel provided on the frame for rotation, wherein the flywheel has two pivoting portions, and the pivoting portions are eccentric;

a first driving unit, which is pivotally connected to the base of the frame, having a tube, a connecting arm, an extending member, a pedal bar, and a pedal, wherein the connecting arm is connected to the tube and pivoted on one of the pivoting portions of the flywheel; the extending member is connected to the tube; and the pedal is connected to the tube through the pedal bar;

a second driving unit, which is pivotally connected to the base of the frame, having a tube, a connecting arm, an extending member, a pedal bar, and a pedal, wherein the connecting arm of the second driving unit is connected to the tube of the second driving unit and pivoted on the other pivoting portion of the flywheel; the extending member of the second driving unit is connected to the tube of the second driving unit; and the pedal of the second driving unit is connected to the tube of the second driving unit through the pedal bar of the second driving unit;

wherein a space is left between the extending members of the first driving unit and the second driving unit to let the extending members move independently;

a first driven unit having a connecting shaft and a handle, wherein the connecting shaft of the first driven unit passes through the tube of the second driving unit to be connected to the extending member of the first driving unit; the handle is connected to the connecting shaft, whereby the handle of the first driven unit and the pedal of the first driving unit move in the same direction;

a second driven unit having a connecting shaft and a handle, wherein the connecting shaft of the second driven unit passes through the tube of the first driving unit to be connected to the extending member of the second driving unit; the handle of the second driven unit is connected to the connecting shaft of the second driven unit, whereby the handle of the second driven unit and the pedal of the second driving unit move in the same direction, and two arms, one arm of said two arms has an end connected to the connecting arm of the first driving unit and an opposite end pivoted on one of the pivoting portions of the flywheel, and the other arm of said two arms has an end connected to the connecting arm of the second driving unit and an opposite end pivoted on the other pivoting portion of the flywheel.

2. The sitting-type exercise machine of claim 1, wherein the tubes of the first driving unit and the second driving unit and the connecting shafts of the first driven unit and the second driven unit are arranged in a line.

3. The sitting-type exercise machine of claim 2, wherein the extending members of the first driving unit and the second driving unit respectively have a connecting board and two lateral boards comprises a first lateral board and a second lateral board, wherein the first and second lateral boards are connected to opposite ends of the connecting board, and the tubes of the first driving unit and the second driving unit are respectively connected to one of the first lateral boards; the connecting shaft of the first driven unit passes through the tube of the second driving unit to be connected to the second lateral board of the first driving unit; and the connecting shaft of the second driven unit passes through the tube of the first driving unit to be connected to the second lateral board of the second driving unit.

4. The sitting-type exercise machine of claim 3, wherein the lateral hoards, which are connected to one of the connecting shafts, respectively have an axial bore and a locking bore, and the locking bore is communicated with the axial bore; the connecting shafts of the first driven unit and the second driven unit are received in the axial bores of the lateral boards respectively; and two pins are inserted into the locking bores and the axial bores to fix the connecting shafts to the lateral boards respectively.

* * * * *